US005336567A

United States Patent [19]

Watanabe et al.

[11] Patent Number: 5,336,567

[45] Date of Patent: Aug. 9, 1994

[54] NICKEL ALLOY ELECTROPLATED COLD-ROLLED STEEL SHEET EXCELLENT IN PRESS-FORMABILITY AND PHOSPHATING-TREATABILITY

[75] Inventors: Toyofumi Watanabe; Akihiko Furuta; Tadashi Ono; Yoshinori Yomura; Shuichi Iwado, all of Tokyo, Japan

[73] Assignee: NKK Corporation, Tokyo, Japan

[21] Appl. No.: 816,372

[22] Filed: Dec. 30, 1991

[30] Foreign Application Priority Data

Jan. 25, 1991 [JP] Japan ..... 3-025696

[51] Int. Cl.[5] ..... C25D 11/02

[52] U.S. Cl. ..... 428/629; 428/679; 428/935; 205/191; 205/258; 205/109

[58] Field of Search ..... 428/629, 679, 935; 205/109, 152, 191, 197, 258

[56] References Cited

U.S. PATENT DOCUMENTS

| | | | |
|---|---|---|---|
| 4,260,449 | 4/1981 | Berdan et al. | 205/152 |
| 4,496,442 | 1/1985 | Okazaki et al. | 205/255 |
| 4,504,326 | 3/1985 | Tokunaga et al. | 148/505 |
| 4,528,070 | 7/1985 | Gamblin | 205/135 |
| 4,889,566 | 12/1989 | Okada et al. | 148/651 |
| 5,124,007 | 6/1992 | Tsuchiya et al. | 205/259 |

FOREIGN PATENT DOCUMENTS

| | | | |
|---|---|---|---|
| 0216044 | 4/1987 | European Pat. Off. . | |
| 59-159994 | 9/1984 | Japan | 205/258 |
| 62-96692 | 5/1987 | Japan . | |
| 63-79996 | 4/1988 | Japan . | |
| 2-101200 | 4/1990 | Japan . | |
| 2-163318 | 6/1990 | Japan . | |

OTHER PUBLICATIONS

"Metals Handbook", 9th edition, vol. 3, 1980 pp. 179–182.

Brenner, "Electrodeposition of Alloys, Principles and Practice", vol. II, 1963, pp. 607–615.

Lowenheim, "Electroplating", 1978, pp. 212–219, 222–223.

Materials Letters, vol. 6, No. 10, pp. 362–364, Jun. 1988, K. Yamakawa et al, "On the Structure of Ni–S Electrodeposits Produced by Direct Current and Pulse Current Methods", Netherlands.

Chemical Abstracts, vol. 108, No. 10, p. 593, Mar. 1988, Abstract No. 84171, U. Akira et al, "Nickel–Boron Alloy Electroplating".

Galvanotechnik, vol. 75, No. 5, p. 634, May 1984, Saulgau, "Electrolyt Zum Oxidieren Eines Mickelphosphoruberzuges Mit Hilfe Von Wechselstrom", Germany.

*Primary Examiner*—John Zimmerman
*Assistant Examiner*—N. M. Nguyen
*Attorney, Agent, or Firm*—Frishauf, Holtz, Goodman & Woodward

[57] ABSTRACT

A nickel alloy electroplated cold-rolled steel sheet excellent in press-formability and phosphating-treatability, which comprises: (a) a cold-rolled steel sheet consisting essentially of: carbon (C): up to 0.06 wt. %, silicon (Si): up to 0.5 wt. %, manganese (Mn): up to 2.5 wt. %, phosphorus (P): up to 0.1 wt. %, sulfur (S): up to 0.025 wt. %, soluble aluminum (Sol.Al): up to 0.10 wt. %, nitrogen (N): up to 0.005 wt. %, and the balance being iron (Fe) and incidental impurities; (b) a nickel alloy electroplating layer, formed on at least one surface of the cold-rolled steel sheet, the nickel alloy electroplating layer consisting of nickel alloy particles precipitated at a distribution density of at least $1\times10^{12}/m^2$, the nickel alloy particles containing at least one of phosphorus (P), boron (B) and sulfur (S) in an amount of 1 to 15 wt. %, the plating weight of the nickel alloy electroplating layer being 5 to 60 $mg/m^2$ per surface of said cold-rolled steel sheet; and (c) a nickel alloy oxide film, formed on the surface of the nickel alloy electroplating layer, having an average thickness of 0.0002 to 0.005 μm.

16 Claims, 5 Drawing Sheets

NICKEL ALLOY ELECTROPLATED COLD-ROLLED STEEL SHEET EXCELLENT IN PRESS-FORMABILITY AND PHOSPHATING-TREATABILITY

REFERENCE OF PATENTS, APPLICATIONS AND PUBLICATIONS PERTINENT TO THE INVENTION

As far as we know, there are available the following prior art documents pertinent to the present invention:

(1) Japanese Patent Provisional Publication No. 63-79,996 dated Apr. 9, 1988; and Japanese Patent Provisional Publication No. 2-101,200 dated Apr. 12, 1990.

The contents of the prior art disclosed in the above-mentioned prior art documents will be discussed hereafter under the heading of the "BACKGROUND OF THE INVENTION."

BACKGROUND OF THE INVENTION

Field of the Invention

The present invention relates to a nickel alloy electroplated cold-rolled steel sheet excellent in press-formability and phosphating-treatability, and a method for manufacturing same.

Prior Art Statement

In general, a cold-rolled steel sheet for automobiles or electric appliances is formed into a prescribed shape by means of a large-capacity-press. With a view to achieving a larger automobile body, reducing air resistance during running of a car, and achieving an exterior view of a better style, it is the present practice to form fenders, doors and rear quarter portions into rounded shapes.

From the point of view of economic merits and environmental protection, on the other hand, efforts are being made to reduce the weight of an automobile body so as to reduce the fuel consumption. In order to reduce the weight of the automobile body, it is necessary to decrease the thickness of a steel sheet which forms the automobile body, and this is also the case with a steel sheet such as an exposed panel that should be subjected to a deep drawing. The steel sheet for an exposed panel requires a satisfactory dent resistance and shape freezability. It is therefore necessary to use a high-strength steel having a thin thickness for the exposed panel. In order to form a thin and high-strength cold-rolled steel sheet by the deep drawing, it is necessary to previously increase the wrinkle inhibiting force of the steel sheet by means of a powerful press so as to prevent wrinkles from producing on the cold-rolled steel sheet during the press forming.

Annealing applied to the cold-rolled steel sheet for the purpose of recrystallization of crystal grains subjected to a serious strain during the cold rolling thereof, is applicable either by a continuous annealing or a box annealing.

An ordinary low-carbon aluminum-killed steel has been used as a material for a mild cold-rolled steel sheet for deep drawing. A low-carbon aluminum-killed steel containing silicon, manganese and phosphorus has been used as a material for a high-strength steel sheet for deep drawing. The box annealing has been applied for the purpose of annealing the above-mentioned mild cold-rolled steel sheet for deep drawing and high-strength steel sheet for deep drawing. The box annealing is characterized by a long heating time, a long cooling time, easy growth of crystal grains, and the availability of a cold-rolled steel sheet having a high Lankford value.

A box-annealed steel sheet is exposed to a high temperature for a longer period of time than a continuous-annealed steel sheet. As a result, silicon, manganese and phosphorus contained in the box-annealed steel sheet are concentrated onto the surface of the steel sheet in the form of oxides. These oxides concentrated onto the surface of the steel sheet serve as a lubricant film during the press forming. In addition, the box-annealed steel sheet has a high Lankford value than that of the continuous-annealed steel sheet. Therefore, troubles such as press cracks hardly occur in the box-annealed steel sheet.

When the box-annealed steel sheet is press-formed and then subjected to a phosphating treatment, the elements contained in the steel sheet and the elements such as manganese concentrated onto the surface of steel sheet activate a phosphate film forming reaction, so that a dense and thin phosphate film is formed on the surface of the steel sheet. The phosphate film has a function of improving paint adhesivity and corrosion resistance after painting of the steel sheet.

Recently, however, it is becoming an increasingly usual practice to anneal a steel sheet by the continuous annealing for such reasons as the reduction of manufacturing processes, the improvement of production yield and labor saving. The known cold-rolled steel sheets suitable for the application of the continuous annealing treatment comprise an extra-low-carbon steel or a steel known as the inter-sticial free steel (hereinafter referred to as "IF steel").

In order to improve a Lankford value serving as an indicator of press-formability of an extra-low-carbon steel sheet, the following measure is taken: degassing the steel during the steelmaking step to reduce the carbon content to up to 100 ppm, and minimizing the contents of other impurity elements, thereby permitting rapid growth of crystal grains of steel.

The IF steel is produced by adding at least one of titanium and niobium to an extra-low-carbon steel, and fixing carbon and nitrogen acting as solid-solution elements by means of these added elements, thereby making it possible to obtain a higher Lankford value with a short-time continuous annealing.

Since the development of the above-mentioned extra-low carbon steel and IF steel, it is now possible to manufacture a cold-rolled steel sheet having a high Lankford value even by applying the continuous annealing.

However, the Lankford value of a cold-rolled steel sheet for deep drawing subjected to the continuous annealing (hereinafter referred to as the "continuous-annealed cold-rolled steel sheet") is equal or even superior to the Lankford value of a cold-rolled steel sheet for deep drawing subjected to the conventional box annealing (hereinafter referred to as the "box-annealed cold-rolled steel sheet"). However, the continuous-annealed cold-rolled steel sheet is easily susceptible to cracks during the press forming, and when worked into a complicated shape, more susceptible to the galling than the box-annealed cold-rolled steel sheet. As a result of various studies on causes thereof, it was revealed that, as shown in Table 1, there was a substantial difference in the value of frictional coefficient of the steel sheet surface between the continuous-annealed cold-rolled steel sheet and the box-annealed cold-rolled steel sheet. Table 1 shows values of frictional coefficient ($\mu$) of the surface, Lankford values ($\bar{r}$-value) and limiting drawing ratios (LDR) for the conventional continuous-annealed and box-annealed cold-rolled steel sheets, and Table 2 shows chemical compositions of the continuous-annealed and box-annealed cold-rolled steel sheets used in these studies.

cold-rolled steel sheet reduces lubricity between the steel sheet surface and the wrinkle inhibiting jig or the die, thus impairing a smooth flow of the material in the press die.

Now, the phosphating-treatability of the continuous-annealed cold-rolled steel sheet is described. Application of a phosphating treatment to the press-formed continuous-annealed cold-rolled steel sheet forms a

TABLE 1

| Box-annealed cold-rolled steel sheet (conventional; without plating) | | | | | | | Continuous-annealed cold-rolled steel sheet (conventional; without plating) | | | | | | |
|---|---|---|---|---|---|---|---|---|---|---|---|---|---|
| Steel grade | Reduction ratio (%) | Heating temperature (°C.) | $\bar{r}$-value | Frictional coefficient ($\mu$) | LDR | Remarks | Steel grade | Reduction ratio (%) | Heating temperature (°C.) | $\bar{r}$-value | Frictional coefficient ($\mu$) | LDR | Remarks |
| A | 60 | 600 | 1.55 | 0.13 | 2.04 | | B | 75 | 750 | 1.45 | 0.16 | 2.01 | |
| A | 65 | 600 | 1.60 | 0.12 | 2.03 | | B | 80 | 750 | 1.50 | 0.17 | 2.01 | |
| A | 70 | 600 | 1.65 | 0.12 | 2.06 | | C | 80 | 830 | 1.75 | 0.16 | 2.05 | |
| A | 75 | 650 | 1.75 | 0.11 | 2.06 | | C | 85 | 830 | 1.75 | 0.17 | 2.04 | |
| A | 80 | 650 | 1.80 | 0.13 | 2.08 | | D | 75 | 830 | 1.95 | 0.19 | 2.07 | |
| A | 85 | 650 | 1.80 | 0.14 | 2.07 | | D | 80 | 830 | 2.05 | 0.17 | 2.08 | |
| A | 75 | 750 | 1.95 | 0.12 | 2.11 | OCA decarburized | D | 80 | 830 | 2.00 | 0.18 | 2.06 | |
| A | 80 | 750 | 2.05 | 0.12 | 2.13 | OCA decarburized | D | 85 | 830 | 2.00 | 0.19 | 2.08 | |
| A | 85 | 750 | 2.05 | 0.11 | 2.11 | OCA decarburized | E | 75 | 830 | 2.05 | 0.17 | 2.07 | |
| F | 75 | 700 | 1.65 | 0.12 | 2.05 | 40 Kg High-strength steel | E | 80 | 830 | 2.20 | 0.18 | 2.10 | |
| | | | | | | | E | 80 | 830 | 2.25 | 0.18 | 2.10 | |
| | | | | | | | E | 85 | 830 | 2.25 | 0.19 | 2.08 | |
| | | | | | | | G* | 80 | 830 | 1.10 | 0.17 | 1.94 | 45 Kg High-strength steel |

(OCA decarburized: open coil annealing decarburized)
(*Only steel G hot-rolled and coiled at a low temperature)

TABLE 2

| | (wt. %) | | | | | | | | | |
|---|---|---|---|---|---|---|---|---|---|---|
| Steel grade | C | Si | Mn | P | S | Sol.Al | N | Nb | Ti | Remarks |
| A | 0.050 | 0.020 | 0.250 | 0.015 | 0.010 | 0.050 | 0.0030 | — | — | Low carbon Al—K CC steel |
| B | 0.025 | 0.015 | 0.200 | 0.014 | 0.009 | 0.045 | 0.0031 | — | — | Medium carbon Al—K CC steel |
| C | 0.003 | 0.012 | 0.150 | 0.014 | 0.010 | 0.038 | 0.0020 | — | — | Extra-low-carbon Al—K CC steel |
| D | 0.003 | 0.012 | 0.130 | 0.015 | 0.008 | 0.037 | 0.0020 | 0.010 | 0.040 | Extra-low-carbon Nb—Ti IF steel |
| E | 0.003 | 0.012 | 0.140 | 0.014 | 0.009 | 0.040 | 0.0020 | — | 0.070 | Extra-low-carbon Ti IF steel |
| F | 0.080 | 0.050 | 0.500 | 0.011 | 0.008 | 0.047 | 0.0035 | — | — | Box-annealed 40 Kg high-strength steel |
| G | 0.032 | 0.350 | 2.200 | 0.040 | 0.005 | 0.030 | 0.0030 | 0.010 | 0.080 | Continuous-annealed 45 Kg high-strength steel |

(Al—K: aluminum killed;
CC steel: continuously cast steel)

FIG. 1 is a graph illustrating the relationship between a Lankford value and a limiting drawing ratio, for a continuous-annealed cold-rolled steel sheet and a box-annealed cold-rolled steel sheet. In FIG. 1, the mark "o" represents the box-annealed cold-rolled steel sheet, and the mark "Δ" represents the continuous-annealed cold-rolled steel sheet. As shown in FIG. 1, the differences in the Lankford value and the limiting drawing ratio between the continuous-annealed and the box-annealed cold-rolled steel sheets are considered to be caused by the fact that a high frictional coefficient of the steel sheet surface as in the continuous-annealed phosphate film on the surface of the continuous-annealed cold-rolled steel sheet. Because the continuous-annealed cold-rolled steel sheet has only low contents of impurity elements, and the time of exposure of the steel sheet surface to a high temperatures during the annealing is far shorter than that in the box-annealed cold-rolled steel sheet, there is almost no concentration of the elements contained in the steel sheet onto the surface thereof. Consequently, there are only a very few cathodes to form precipitation nuclei of phosphate crystal grains on the surface of the continuous-annealed chid-rolled steel sheet, so that a phosphate film formed on the steel sheet surface comprises rough and coarse crystal grains.

FIG. 5 is an SEM (scanning electron microscope) micrograph showing the metallurgical structure of crystals of the phosphate film formed on the surface of the box-annealed cold-rolled steel sheet, and FIG. 6 is an SEM micrograph showing the metallurgical structure of crystals of the phosphate film formed on the surface of the continuous-annealed cold-rolled steel sheet. As shown in FIG. 6, the phosphate film formed on the surface of the continuous-annealed cold-rolled steel sheet has coarse and larger crystal grains than those formed on the surface of the box-annealed cold-rolled steel sheet shown in FIG. 5. The continuous-annealed cold-rolled steel sheet is therefore inferior in phosphating-treatability, paint adhesivity and corrosion resistance after painting to the box-annealed cold-rolled steel sheet.

The above-mentioned inferiority of the continuous-annealed cold-rolled steel sheet in phosphating-treatability is observed when pickling the steel sheet surface with an inorganic acid not only in the case of an extra-low-carbon steel but also in the case of an ordinary low-carbon aluminum-killed steel and a capped steel.

As a means to solve the problem regarding the inferior phosphating-treatability of the pickled continuous-annealed cold-rolled steel sheet, technologies of forming an alloy plating layer comprising phosphorus and at least one of nickel and niobium on the surface of the cold-rolled steel sheet have been proposed as follows:

An alloy plated extra-low-carbon steel sheet excellent in phosphating-treatability, as disclosed in Japanese Patent Provisional Publication No. 63-79,996 dated Apr. 9, 1988, which comprises:

an extra-low-carbon steel sheet containing carbon in an amount of up to 0.005 wt %, at least one of titanium and niobium in an amount within a range of from 0.005 to 0.15 wt. % and the balance being iron and incidental impurities; and an alloy plating layer, formed on the surface of said extra-low-carbon steel sheet, comprising phosphorus and at least one of nickel and cobalt, the content of said phosphorus being within a range of from 1 to 30 wt. %, said alloy plating layer having a plating weight within a range of from 10 to 500 mg/m$^2$per surface of said extra-low-carbon steel sheet (hereinafter referred to as the "prior art 1").

According to the prior art 1, it is possible to obtain an alloy plated continuous-annealed cold-rolled steel sheet excellent in phosphating-treatability comprising an extra-low-carbon steel. This is attributable to the fact that phosphorus contained in the alloy plating layer promotes the cathodic reaction on the steel sheet surface, thus making it possible to obtain an excellent phosphating-treatability.

The prior art 1 has however the following problems.

In order for the continuous-annealed cold-rolled steel sheet to have a phosphating-treatability equal to that of the box-annealed cold-rolled steel sheet, it is necessary to adjust the number of initially precipitated nuclei of phosphate, i.e., the number of local cells produced on the steel sheet surface to a certain distribution density. For this purpose, it is important that the alloy particles comprising nickel and/or cobalt and phosphorus are precipitated into the alloy plating layer, and that the distribution density of the alloy particles is at least a certain value. According to the prior art 1, there is no description in this respect. An excellent phosphating-treatability cannot necessarily be obtained by only forming the alloy plating layer comprising nickel and/or cobalt and phosphorus on the steel sheet surface.

When the plating weight of the alloy plating layer comprising nickel and/or cobalt and phosphorus is over 100 mg/m$^2$ per surface of the steel sheet, the coating ratio of the steel sheet surface by the alloy plating layer becomes higher, with a reduced distribution density of the precipitation nuclei of phosphate, and crystal grains of the phosphate film become coarser. As a result, the deposited amount of the phosphate film is insufficient relative to the prescribed value, leading to a poor paint adhesivity and a poor corrosion resistance after painting.

As it is difficult to plate phosphorus alone on the steel sheet surface, phosphorus is alloyed with nickel and/or cobalt for plating. Phosphorus has a function of increasing hardness of the alloy plating layer, facilitating the formation of an oil film on the sliding face of the steel sheet surface, and thus decreasing a frictional coefficient. However, a phosphorus content of over 15 wt. % seriously reduces the electrolytic efficiency upon electroplating, thus increasing the equipment cost for continuous annealing which requires a high-speed operation.

Because the increase in the plating weight of the alloy plating layer comprising nickel and/or cobalt and phosphorus leads to a lower phosphating-treatability of the cold-rolled steel sheet, it is necessary to minimize the plating weight of the above-mentioned alloy plating layer as far as possible. However, when the plating weight of the alloy plating layer is reduced, the frictional coefficient of the steel sheet surface increases, thus resulting in a poorer press-formability. An excellent press-formability cannot always be obtained therefore according to the prior art 1.

As a technology for improving phosphating-treatability and corrosion resistance of the cold-rolled steel sheet, the following cold-rolled steel sheet is proposed;

A nickel plated cold-rolled steel sheet excellent in phosphating-treatability and corrosion resistance, disclosed in ,Japanese Patent Publicational Publicatin No. 2-101,200 dated Apr. 12, 1990, which comprises:

A cold-rolled steel sheet; and a nickel plating layer, formed on the surface of said cold-rolled steel sheet, in which layer nickel particles are precipitated at a distribution density within a range of from $1\times10^{12}$ to $5\times10^{14}$/m$^2$ the plating weight of said nickel plating layer being within a range of from 1 to 50 mg/m$^2$ per surface of said cold-rolled steel sheet, each of said nickel particles comprising metallic nickel and non-metallic nickel, having a thickness within a range of from 0.0009 to 0.03 $\mu$m, adhering to the surface of said metallic nickel, and said nickel particles having a particle size within a range of from 0.001 to 0.3 $\mu$m (hereinafter referred to as the "prior art 2").

According to the above-mentioned prior art 2, it is possible to form a dense and uniform phosphate film having a crystal grain size within a certain range, thereby making it possible to obtain a cold-rolled steel sheet excellent in phosphating-treatability and corrosion resistance. In addition, the prior art 2 permits the reduction of frictional coefficient of the surface of the continuous-annealed cold-rolled steel sheet.

However, our detailed studies revealed that the prior art 2 had the following problems.

In the prior art 2, when the plating weight of the nickel plating layer is under 5 mg/m$^2$, a cold-rolled steel sheet excellent in phosphating-treatability is unavailable. The reason is as follows: The number of initially precipitated nuclei of phosphate, which is required for forming a dense and uniform phosphate film and giving a crystal grain size within a certain range by means of the phosphating treatment, is within a range of from $1\times10^{10}$ to $5\times10^{11}$/m$^2$ in terms of the distribution density.

In order to limit the distribution density of nickel particles in the nickel plating layer within the range of from $1\times10^{12}$ to $5\times10^{14}$/m$^2$ as described above, however, the plating weight of the nickel plating layer must be at least 5 mg/m$^2$. According to the prior art 2, however, the plating weight of the nickel plating layer is disclosed to be within a range of from 1 to 50 mg/m$^2$. Accordingly, when the plating weight of the nickel plating layer is under 5 mg/m$^2$, it is impossible to achieve a distribution density of the nickel particles of at least $1\times10^{12}$/m$^2$. Therefore, the number of initially precipitated nuclei of phosphate cannot in some cases be kept within a desired range described above by the prior art 2, in which case an excellent phosphating-treatability of the steel sheet is unavailable.

In the prior art 2, furthermore, improvement of phosphating-treatability and reduction of frictional coefficient of the surface of the cold-rolled steel sheet are attempted by forming a non-metallic nickel film on the surface of the nickel plating layer. However, non-metallic nickel is basically a metal oxide, and as disclosed in the examples of the prior art 3, when forming a non-metallic nickel oxide film having an average thickness of at least 0.005 μm on the steel sheet surface by subjecting the steel sheet to an anodic electrolytic treatment in an alkaline bath, non-metallic nickel oxide film having an average thickness larger than the above is formed on a portion of the steel sheet surface not having a nickel plating layer. Consequently, although press-formability is improved, the phosphate film contains more portions with a small deposited weight, thus resulting in a lower paint adhesivity and a poorer corrosion resistance after painting.

Because of the low hardness of nickel, improvement of press-formability through the reduction of frictional coefficient of the surface of the steel sheet requires formation of a thicker nickel oxide film on the surface of the nickel electroplating layer. An increased deposited amount of the nickel oxide film leads however to a lower phosphating-treatability.

In the prior art 2, therefore, it is difficult to improve simultaneously press-formability and phosphating-treatability.

When manufacturing a cold-rolled steel sheet for deep drawing by using a mild steel sheet as the material and subjecting same to a continuous annealing treatment, it is necessary to solve simultaneously the two problems of a decrease in phosphating-treatability as well as in press-formability.

Under such circumstances, there is a strong demand for the development of a nickel alloy electroplated cold-rolled steel sheet for deep drawing excellent in press-formability and phosphating-treatability, suitable for the application of the continuous annealing treatment, but such a cold-rolled steel sheet and a method for manufacturing same have not as yet been proposed.

SUMMARY OF THE INVENTION

An object of the present invention is therefore to provide a nickel alloy electroplated cold-rolled steel sheet for deep drawing excellent in press-formability and phosphating-treatability, suitable for the application of the continuous annealing treatment.

In accordance with one of the features of the present invention, there is provided a nickel alloy electroplated cold-rolled steel sheet excellent in press-formability and phosphating-treatability, which comprises:

a cold-rolled steel sheet consisting essentially of:
carbon (C): up to 0.06 wt. %,
silicon (Si): up to 0.5 wt. %,
manganese (Mn): up to 2.5 wt. %,
phosphorus (P): up to 0.1 wt. %,
sulfur (S): up to 0.025 wt. %,
soluble aluminum ( Sol.Al): up to 0.10 wt. %,
nitrogen (N): up to 0.005 wt. %, and
the balance being iron (Fe) and incidental impurities;

a nickel alloy electroplating layer, formed on at least one surface of said cold-rolled steel sheet, in which layer nickel alloy particles are precipitated at a distribution density of at least $1\times10^{12}$/m$^2$, said nickel alloy particles containing at least one of phosphorus (P), boron (B) and sulfur (S) in an amount within a range of from 1 to 15 wt. %, the plating weight of said nickel alloy electroplating layer being within a range of from 5 to 60 mg/m$^2$ per surface of said cold-rolled steel sheet; and a nickel alloy oxide film, formed on the surface of said nickel alloy electroplating layer, having an average thickness within a range of from 0.0002 to 0.005 μm.

In accordance with another one of the features of the present invention, there is provided a method for manufacturing a nickel alloy electroplated cold-rolled steel sheet excellent in press-formability and phosphating-treatability, which comprises the steps of:

preparing a steel ingot consisting essentially of:
carbon (C): up to 0.06 wt. %,
silicon (Si): up to 0.5 wt. %,
manganese (Mn): up to 2.5 wt. %,
phosphorus (P): up to 0.1 wt. %,
sulfur (S): up to 0.025 wt. %,
soluble aluminum (Sol.Al): up to 0.10 wt. %,
nitrogen (N) up to 0 005 wt %, and
the balance being iron (Fe) and incidental impurities; then hot-rolling said steel ingot to prepare a hot-rolled steel sheet; then cold-rolling said hot-rolled steel sheet at a reduction ratio within a range of from 60 to 85% to prepare a cold-rolled steel sheet; then subjecting said cold-rolled steel sheet to a continuous annealing treatment which comprises heating said cold-rolled steel sheet to a recrystallization temperature and then slowly cooling same; then subjecting said continuously annealed cold-tolled steel sheet to a continuous nickel alloy electroplating treatment in an acidic electroplating bath to form a nickel alloy electroplating layer, in which layer nickel alloy particles are precipitated at a distribution density of at least $1\times10^{12}$/m$^2$, on at least one surface of said cold-rolled steel sheet, said nickel alloy particles containing at least one of phosphorus (P), boron (B) and sulfur (S) in an amount within a range of from 1 to 15 wt. %, said nickel alloy electroplating layer having a plating weight within a range of from 5 to 60 mg/m$^2$ per surface of said cold-rolled steel sheet; and then immersing said cold-rolled steel sheet having said nickel alloy electroplating layer on said at least one surface thereof into a neutral bath or an alkaline bath to form a nickel alloy oxide film having an average thickness within a range of from 0.0002 to 0.005 μm on said nickel alloy electroplating layer.

In the above-mentioned nickel alloy electroplated cold-rolled steel sheet and manufacturing method therefor, said cold-rolled steel sheet may additionally contain any one of the following element (1) Titanium (Ti) in an amount of up to 0.15 wt. %;

(2) Niobium (Nb) in an amount of up to 0.15 wt. %;

(3) Titanium (Ti) in an amount of up to 0.15 wt. % and niobium (Nb) in an amount of 0.15 wt. %;

(4) Titanium (Ti) in an amount of up to 0.15 wt. % and boron (B) in an amount of up to 0.003 wt. %;

(5) Niobium (Nb) in an amount of up to 0.15 wt. % and boron (B) in an amount of up to 0.003 wt. %; and (6) Titanium (Ti) in an amount of up to 0.15 wt. %, niobium (Nb) in an amount of up to 0.15 wt. % and boron (B) in an amount of up to 0.003 wt. %.

DETAILED DESCRIPTION OF PREFERRED EMBODIMENTS

Figure 1:
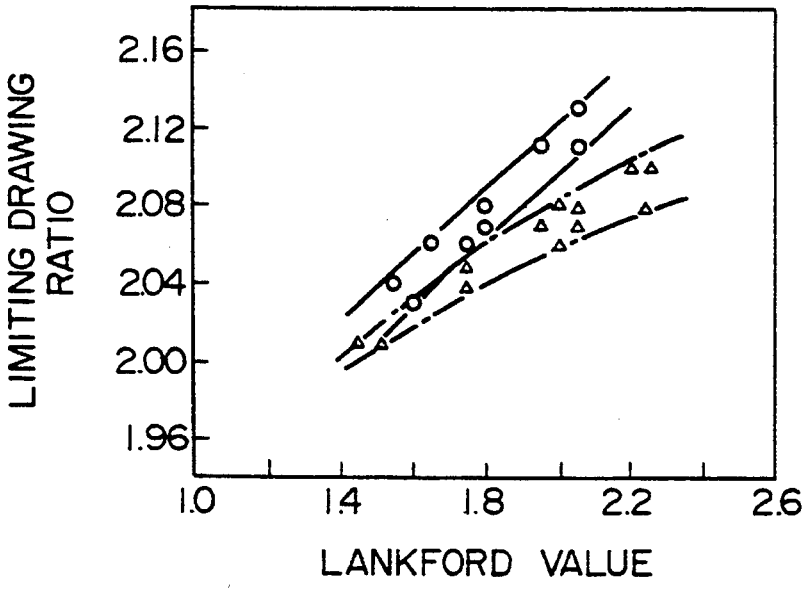
FIG. 1 is a graph illustrating the relationship between the Lankford value and the limiting drawing ratio, for the conventional continuous-annealed cold-rolled steel sheet and the conventional box-annealed cold-rolled steel sheet, both without plating.

From the above-mentioned point of view, extensive studies were carried out to develop a nickel alloy electroplated cold-rolled steel sheet excellent in press-formability and phosphating-treatability and a method for manufacturing same. As a result, the following findings were obtained:

(1) By forming a nickel alloy electroplating layer having a prescribed plating weight, in which layer nickel alloy particles are precipitated at a prescribed distribution density, on the surface of a continuous-annealed cold-rolled steel sheet having a specific chemical composition, then forming a nickel alloy oxide film having a prescribed average thickness on the surface of the nickel alloy electroplating layer, and then subjecting the cold-rolled steel sheet to a phosphating treatment to form a phosphate film on the surface of the nickel alloy oxide film, the phosphate film becomes denser, and paint adhesivity and corrosion resistance after painting are further improved.

(2) Phosphorus, boron and sulfur contained in the nickel alloy electroplating layer formed on the surface of the steel sheet improve hardness of the nickel alloy electroplating layer and press-formability of the steel sheet.

The present invention was made on the basis of the above-mentioned findings. Now, the nickel alloy electroplated cold-rolled steel sheet excellent in press-formability and phosphating-treatability of the present invention and the method for manufacturing same are described further in detail.

The chemical composition of the cold-rolled steel sheet of the present invention is limited within the above-mentioned range for the following reasons.

(1) Carbon:

A carbon content of over 0.06 wt. % seriously impairs ductility of the cold-rolled steel sheet, thus leading to a poorer workability. A carbon content of under 0.0005 wt. % results, on the other hand, in a longer refining time of steel, which is economically unfavorable.

(2) Silicon and manganese:

Silicon and manganese are added to a high-strength steel sheet required to have a high press-formability. Silicon and manganese are elements which strengthen the solid-solution. Addition of silicon and manganese improves strength of the cold-rolled steel sheet without seriously impairing workability thereof. However, because of the easy oxidation of these elements, a silicon content of over 0.5 wt. % or a manganese content of over 2.5 wt. % causes oxidation of the steel sheet surface, thus impairing the surface appearance unique to the cold-rolled steel sheet. A silicon content of under 0.005 wt. % or a manganese content of under 0.05 wt. % results on the other hand in a longer refining time of steel, which is economically unfavorable.

(3) Phosphorus:

Phosphorus has a function of improving strength of the cold-rolled steel sheet. A phosphorus content of over 0.1 wt. % causes however longitudinal cracks during the deep drawing of the cold-rolled steel sheet. A phosphorus content of under 0.001 wt. % results on the other hand in a longer refining time of steel, which is economically unfavorable.

(4) Sulfur and nitrogen:

A lower sulfur content or a lower nitrogen content brings about an improved press-formability of the cold-rolled steel sheet. A sulfur content of over 0.025 wt. % or a nitrogen content of over 0.005 wt. % is however economically unfavorable. A sulfur content of under 0.005 wt. % or a nitrogen content of under 0.0005 wt. % results on the other hand in a longer refining time of steel, which is economically unfavorable.

(5) Soluble aluminum:

Soluble aluminum is contained in steel as a residue of aluminum (Al) used as a deoxidizing agent. When a hot-rolled coil is prepared in the hot-rolling process at a coiling temperature of at least 640° C., soluble aluminum has functions of fixing nitrogen and improving formability. By adjusting the soluble aluminum content to at least 0.01 wt. %, it is possible to obtain a stably deoxidized aluminum-killed steel. With a soluble aluminum content of over 0.1 wt. %, however, the above-mentioned effects are saturated.

(6) Titanium and niobium:

Titanium and niobium are additionally added as required in cases where a very high formability is required to the cold-rolled steel sheet. Titanium and niobium have a function of fixing carbon and nitrogen, thus making it possible to manufacture IF steel by adding titanium and/or niobium to steel. The contents of titanium and niobium are dependent on the contents of carbon and nitrogen. With the contents of titanium and nitrogen of over 0.15 wt. %, respectively, a desired effect of fixing carbon and nitrogen is unavailable and economic demerits are encountered. When the contents of titanium and niobium are under 0.001 wt. %, respectively, the effect as described above is unavailable.

(7) Boron:

Boron has a function of preventing longitudinal cracks inevitably occurring in a cold-rolled steel sheet which comprises the IF steel containing titanium and/or niobium. Addition of boron improves deep-drawability of the cold-rolled steel sheet. Therefore, boron is additionally added as required together with titanium and/or niobium. A boron content of over 0.003 wt. % leads however to a lower ductility of the cold-rolled steel sheet. With a boron content of under 0.0002 wt. %, on the other hand, a desired effect as described above is unavailable.

In the present invention, a nickel alloy electroplating layer is formed on the surface of the continuous-annealed cold-rolled steel sheet having the above-mentioned chemical composition. Nickel alloy particles, each containing at least one of phosphorus (P), boron (B) and sulfur (S) in an amount within a range of from 1 to 15 wt. %, are precipitated in the nickel alloy electroplating layer at a distribution density of at least $1\times10^{12}/m^2$, and the nickel alloy electroplating layer has a plating weight within a range of from 5 to 60 $mg/m^2$ per surface of the cold-rolled steel sheet. The reasons are as follows.

In order to improve phosphating-treatability of the continuous-annealed cold-rolled steel sheet, it is necessary that cathodes serving as precipitation nuclei for the precipitation of hopeite ($Zn_3(PO_4)_2$) and phosphophyllite ($Zn_2Fe(PO_4)_2$), which are phosphate crystals, are distributed at a certain density on the surface of the continuous-annealed cold-rolled steel sheet to form initially precipitated nuclei of phosphate known as local cells. The number of cathodes distributed on the surface of the steel sheet is equal to the number of local cells formed under the effect of the difference in potential which is produced by elements concentrated on the steel sheet surface and nickel alloy particles precipitated in the nickel alloy electroplating layer formed on the steel sheet surface.

In order to ensure an excellent paint adhesivity and an excellent corrosion resistance after painting, the crystal grains of the phosphate film should have a grain size within a certain range, and for this purpose, the number of initially precipitated nuclei of phosphate should have a distribution density within a range of from $1\times10^{10}$ to $5\times10^{11}/m^2$. In order for the number of initially precipitated nuclei of phosphate to achieve a distribution density within the above-mentioned range, the nickel alloy particles precipitated in the nickel alloy electroplating layer should have a distribution density within a range of from $1\times10^{12}$ to $5\times10^{14}/m^2$. Furthermore, to achieve a distribution density of the precipitated nickel alloy particles within the above-mentioned range, it is necessary to limit the plating weight of the nickel alloy electroplating layer within a range of from 5 $mg/m^2$ to 60 $mg/m^2$ per surface of the cold-rolled steel sheet. By limiting the plating weight of the nickel alloy electroplating layer within the above-mentioned range, it is possible to adjust the distribution density of the nickel alloy particles precipitated in the nickel alloy electroplating layer to at least $1\times10^{12}/m^2$, and hence, to ensure the number of initially precipitated nuclei of phosphate necessary for the phosphating treatment, thereby reducing the frictional coefficient.

The average grain size of phosphate crystals thus made available by limiting the plating weight of the nickel alloy electroplating layer and the distribution density of the precipitated nickel alloy particles, is within a range of from 1 to 3 μm, which is equal to that of the phosphate crystals formed on the surface of the box-annealed cold-rolled steel sheet. This permits achievement of satisfactory paint adhesivity and corrosion resistance after painting.

With a plating weight of the nickel alloy electroplating layer of under 5 $mg/m^2$ per surface of the cold-rolled steel sheet, however, it is impossible to adjust the distribution density of the nickel alloy particles to at least $1\times10^{12}/m^2$, thus making it impossible to ensure the number of initially precipitated nuclei necessary for the phosphating treatment. In addition, a desired effect of reducing frictional coefficient of the steel sheet surface is unavailable. With a plating weight of the nickel alloy electroplating layer of over 60 $mg/m^2$, on the other hand, the above-mentioned effect reaches saturation, and the resultant consumption is only uneconomical. A plating weight of the nickel alloy electroplating layer of over 60 $mg/m^2$, furthermore, leads to a decreasing tendency of the number of initially precipitated nuclei of phosphate, which is an adverse effect.

Phosphorus has a function of increasing hardness of the nickel alloy electroplating layer, thus improving press-formability of the cold-rolled steel sheet, and exerts no adverse effect on phosphating-treatability thereof. Hardness of an alloy comprising nickel and phosphorus is within a range of from Hv500 to Hv600 in Vickers hardness, which is considerably higher than that of nickel which is within a range of from Hv200 to Hv250 in Vickers hardness. However, with a phosphorus content of under 1 wt. % in the nickel alloy electroplating layer, a desired effect as described above is unavailable. With a phosphorus content of over 15 wt. % in the nickel alloy electroplating layer, on the other hand, the above-mentioned effect reaches saturation thereof. A phosphorus content of over 15 wt. % further leads to a considerable decrease in the electrolytic efficiency, so that it is necessary to improve the control accuracy of the electroplating bath through, for example, control of pH-value and ions. In the continuous annealing operation at a high speed, however, it is difficult to accomplish a perfect control even by expanding the auxiliary facilities and increasing the number of plating tanks.

Boron has a function of increasing hardness of the nickel alloy electroplating layer, thus improving pressformability of the cold-rolled steel sheet, and exerts no adverse effect on phosphating-treatability thereof. Hardness of an alloy comprising nickel and boron is within a range of from Hv600 to Hv800 in Vickers hardness, which is considerably higher than that of nickel. However, with a boron content of under 1 wt. % in the nickel alloy electroplating layer, a desired effect as described above is unavailable. With a boron content of over 15 wt. % in the nickel alloy electroplating layer, on the other hand, the above-mentioned effect reaches saturation thereof.

The reason why phosphorus and boron reduce the frictinal coefficient of the nickel alloy electroplating layer, is not as yet known, but is conjectured to be attributable to the fact that a higher hardness of the nickel alloy electroplating layer makes adhesion between the surfaces in contact more difficult to occur, and the precipitated nickel alloy particles serve as rollers. The difficulty in occurrence of adhesion facilitates the formation of a lubricant film between the surfaces in contact. Oiliness improving agents such as ester and fatty acid contained in the lubricant oil are adsorbed on the surface of the nickel alloy electroplating layer activated by means of local cells produced on the nickel alloy electorplating layer, thus forming a powerful lubricant film.

Sulfur, though being lower in hardness than phosphorus and boron, has a function of reducing the frictional coefficient of the nickel ally electroplating layer to the same extent as phosphorus and boron. The reason is not known, but is considered to be attributable to the fact that, because of the hydrogen overvoltage of sulfur lower than that of phosphorus and boron, the activity of the oiliness improving agents is improved, thus increasing the amount of lubricant oil adsorbed on the surface of the nickel alloy electroplating layer. With a sulfur content of under 1 wt. % in the nickel alloy electroplating layer, however, a desired effect as described above is unavailable. With a sulfur content of over 15 wt. % in the nickel alloy electroplating layer, on the other hand, the above-mentioned effect reaches saturation thereof.

In the present invention, a nickel alloy oxide film having an average thickness within a range of from 0.0002 to 0.005 μm is formed on the surface of the nickel alloy electroplating layer. The reason is as follows.

In order to increase hardness of the steel sheet surface, it is necessary to increase the plating weight of the nickel alloy electroplating layer. However, when increasing the plating weight of the nickel alloy electroplating layer, it becomes impossible to keep the distribution density of the nickel alloy particles precipitated therein within an appropriate range. In the present invention, therefore, the plating weight of the nickel alloy electroplating layer is not increased, but a nickel alloy oxide film having an average thickness within a range of from 0.0002 to 0.005 μm, or more preferably, within a range of from 0.001 to 0.003 μm is formed on the surface of the nickel alloy electroplating layer so as to increase lubricity of the steel sheet surface. This permits the reduction of frictional coefficient of the steel sheet surface. An average thickness of the nickel alloy oxide film of under 0.0002 μm cannot provide a desired effect of reducing the frictional coefficient.

On the other hand, because the nickel alloy oxide film is an electric insulator, an average thickness thereof of over 0.005 μm hinders smooth flow of electric current for causing the precipitation of phosphate crystals. Therefore, when a nickel alloy oxide film is formed through an anodic electrolytic treatment in a neutral or alkaline bath, if a bath concentration is high or an electrolytic current is large, a thick nickel alloy oxide film is formed, not only on the surface of the nickel alloy electroplating layer, but also on the surface portions of the steel sheet not covered with the nickel alloy electroplating layer. This reduces the number of initially precipitated nuclei of phosphate, leading to coarser crystal grains of phosphate, thus preventing the formation of a dense phosphate film. For this reason, the average thickness of the nickel alloy oxide film should be limited within a range of from 0.0002 to 0.005 μm, or more preferably, from 0.001 to 0.003 μm.

The above-mentioned nickel alloy electroplated cold-rolled steel sheet of the present invention is manufactured as follows.

A steel ingot having a chemical composition within the above-mentioned range of the present invention is prepared. Then, the steel ingot is hot-rolled to prepare a hot-rolled steel sheet.

Then, the hot-rolled steel sheet is cold-rolled at a reduction ratio within a range of form 60 to 85% to prepare a cold-rolled steel sheet. The reduction ratio in the cold-rolling should be limited within the range of from 60 to 85%. With a reduction ratio of under 60% or over 85% in the cold-rolling, a sufficient deep-drawability of the cold-rolled steel sheet is unavailable.

Then, the thus prepared cold-rolled steel sheet is subjected to a continuous annealing treatment which comprises heating the cold-rolled steel sheet to a recrystallization temperature and then slowly cooling same.

An exemplification of the continuous annealing treatment in the present invention is described. More specifically, the cold-rolled steel sheet is heated to a recrystallization temperature, and held at this temperature for a period of time within a range of from three to ten minutes. Then, the thus heated cold-rolled steel sheet is slowly cooled to a temperature of about 50° C. at a cooling rate of up to 5° C./sec appropriately selected depending upon the grade of steel.

Another exemplification of the continuous annealing treatment in the present invention is as follows. The cold-rolled steel sheet is heated to a recrystallization temperature, and held at this temperature for a period of time within a range of from three to ten minutes. Then, the thus heated cold-rolled steel sheet is rapidly cooled to a temperature of up to 450° C. at a cooling rate of at least 10° C./sec. Then, the steel sheet is subjected to an overaging treatment at a temperature within a range of from 250° to 400° C. for a period of time within a range of from one to three minutes. Then, the steel sheet is cooled to a temperature of up to 50° C.

The cold-rolled steel sheet is thus subjected to the continuous annealing treatment because of the possibility of reducing the operation time, the availability of uniformity in quality, and the potential improvement of product yield and productivity.

Subsequently, the thus continuous-annealed cold-rolled steel sheet is subjected to a continuous nickel alloy electroplating treatment in an acidic electroplating bath to form, on at least one surface of the cold-rolled steel sheet, a nickel alloy electroplating layer having a plating weight within a range of from 5 to 60 $mg/m^2$ per surface of the cold-rolled steel sheet, in which layer nickel alloy particles are precipitated at a distribution density of at least $1\times10^{12}/m^2$.

The nickel alloy particles may be precipitated on the surface of the cold-rolled steel sheet by a substitution method which comprises immersing the cold-rolled steel sheet in an acidic plating bath, but in order to cause stable precipitation of the nickel alloy particles at a constant distribution density, the electroplating treatment should be employed.

Then, the cold-rolled steel sheet on at least one surface of which the nickel alloy electroplating layer has thus been formed, is immersed into a neutral bath or an alkaline bath, or is subjected to an anodic electrolytic treatment in the neutral bath or the alkaline bath. A nickel alloy oxide film having an average thickness within a range of from 0.0002 to 0.005 μm is thus formed on the surface of the nickel alloy electroplating layer. An aqueous solution of 10 g/l sodium carbonate ($Na_2CO_3$) is applicable as an alkaline bath.

Prior to the continuous nickel alloy electroplating treatment, the surface of the cold-rolled steel sheet is cleaned by a pickling as required. The pickling is applied because a continuous annealing equipment is in many cases provided with a direct heating furnace on the entry side and a rapid cooling apparatus such as a water cooling device and an air/water cooling device in a rapid cooling zone in the middle so that the increase in the dew point of the atmospheric gas during the heating produces an iron oxide film on the steel sheet surface, and this may prevent the nickel alloy particles from being precipitated in a desirable state. While the immersion method in a hydrochloric acid bath is adopted for pickling in these exemplifications, use of the immersion method in a sulfuric acid bath or an electrolytic treatment in a diluted sulfuric acid bath for the pickling does not impair the essence of the present invention.

Now, the present invention is described further in detail by means of examples while comparing with examples for comparison.

EXAMPLE

Steels B to G each having a chemical composition as shown in Table 2 were refined, and then slabs were prepared from the respective steels B to G by the continuous casting method. Then, the thus prepared slabs were hot-rolled to prepare respective hot-rolled steel sheets having a prescribed thickness. The finishing temperature of each of the hot-rolled steel sheets was a temperature of at least the $Ar_3$ transformation point of each of the steels, and the coiling temperature in the hot-rolling was 730° C. for the steels B to E and G, and 560° C. for the steel F. Then, the hot-rolled steel sheets were subjected to the pickling by the hydrochloric acid pickling method to remove scale from the surfaces of the hot-rolled steel sheets.

Then, the pickled hot-rolled steel sheets were cold-rolled under the conditions as shown in Table 4 to prepare respective cold-rolled steel sheets having a thickness within a range of from 0.8 to 1.0 mm. Then, the cold-rolled steel sheets were subjected to a continuous annealing treatment under the conditions as shown in Table 4. Then, the thus continuous-annealed cold-rolled steel sheets were immersed in an acidic bath comprising hydrochloric acid as shown in Table 3 to apply a pickling under the conditions as shown in Table 3.

Then, each of the pickled cold-rolled steel sheets was subjected to a continuous nickel alloy electroplating treatment in a nickel alloy electroplating bath as shown in Table 3 under the conditions as shown also in Table 3. Then, the cold-rolled steel sheet having the nickel alloy electroplating layer formed thereon was subjected to an anodic electrolytic treatment in an aqueous solution of sodium hydrogencarbonate ($NaHCO_3$) under the conditions as shown in Table 3 to form a nickel alloy oxide film on the surface of the nickel alloy electroplating layer. The cold-rolled steel sheets on each of which the nickel alloy electroplating layer and the nickel alloy oxide film had been formed, were subjected to a temper rolling with an elongation ratio of about 1.0% to prepare samples of the nickel alloy electroplated cold-rolled steel sheet within the scope of the present invention (hereinafter referred to as the "samples of the invention") Nos. 1 to 17.

For comparison purposes, samples of the nickel alloy electroplated cold-rolled steel sheet outside the scope of the present invention (hereinafter referred to as the "samples for comparison") Nos. 1 to 13 were prepared by the use of the steels D and E each having a chemical composition within the scope of the present invention as shown in Table 2. The samples for comparison Nos. 1 to 13 had a plating weight of the nickel alloy electroplating layer outside the scope of the present invention or an average thickness of the nickel alloy oxide film outside the scope of the present invention as shown in Table 3.

For each of the thus prepared samples of the invention Nos. 1 to 17 and the samples for comparison Nos. 1 to 13, a frictional coefficient (μ) of the steel sheet surface, a limiting drawing ratio (LDR), a Lankford value ($\bar{r}$-value), phosphating-treatability, a distribution density of the nickel alloy particles in the nickel alloy electroplating layer, and an average thickness of the nickel alloy oxide film were investigated in accordance with the following test methods. The results are shown in Tables 4 and 5. The values of hardness of the samples for comparison Nos. 8 to 13 are shown in Table 5.

Test method of frictional coefficient of steel sheet surface:

A test piece having a size of 30 mm×200 mm was cut out from each of the samples of the invention Nos. 1 to 17 and the samples for comparison Nos. 1 to 13. The test piece was placed on guide rollers, and then a pressing member having a size of 3 mm×10 mm was pressed under a pressure of 400 kg·f from above onto the surface of the test piece. Then, in this state, the test piece was withdrawn at a speed of 1,000 m/minute to determine the withdrawing force F (kg·f) at this moment, and the frictional coefficient $\mu=400/F$ was calculated from the thus determined withdrawing force F. The surface roughness was previously imparted to the bottom surface of the pressing member in the direction at right angles to the sliding direction by means of diamond particles having a particle size of about 3 μm.

Test method of limiting drawing ratio:

A plurality of disks having various diameters were cut out from each of the samples of the invention Nos. 1 to 17 and the samples for comparison Nos. 1 to 13.

Then, these disks were drawn by means of a punch having a diameter of 50 mm and a die. The ratio of the maximum disk diameter, in which cracks had not been produced on the disk, to the punch diameter was determined as a limiting drawing ratio. When measuring the limiting drawing ratio, a commercially available anticorrosive oil was smeared as a lubricant on the disk, the punch and the die.

Test method of Lankford value:

For each of the samples of the invention Nos. 1 to 17 and the samples for comparison Nos. 1 to 13, a Lankford value (r̄-value) was measured by a known method prior to forming the nickel alloy electroplating layer.

Test method of phosphating-treatability:

Each of the samples of the invention Nos. 1 to 17 and the samples for comparison Nos. 1 to 13 was immersed for 15 seconds in a phosphating treatment solution (manufactured by Japan Perkerizing Co., Ltd.; PB-3030), then rinsed and dried. The surface of each of the samples of the invention and the samples for comparison thus immersed in the phosphating treatment solution was observed by means of a scanning type electron microscope to measure the number of initially precipitated nuclei of phosphate. In addition, each of the samples of the invention and the samples for comparison was immersed in the above-mentioned phosphating treatment solution for 120 seconds to form a phosphate film completely on the surface of the steel sheet, and was observed by means of the scanning type electron microscope to measure the grain size of phosphate crystal grains and the appearance of the phosphate film. The appearance of the phosphate film was evaluated in accordance with the following criteria:

◎: the phosphate crystal grain has a grain size within a range of from 1.5 to 2.5μm, and the deposited amount of the phosphate film is sufficient;

○: the phosphate crystal grain has a grain size within a range of from 1.0 to under 1.5 μm or from over 2.5 μm to 3.0μm, and the deposited amount of the phosphate film is sufficient;

Δ: the phosphate crystal grain has a grain size of over 3.0 μm, and the deposited amount of the phosphate film is sufficient, ×: the phosphate crystal grain has a grain size of over 3.0 μm, and the deposited amount of the phosphate film is insufficient.

The phosphate film was peeled off by the reverse electrolysis to determine the deposited amount of the phosphate film from the difference in weight between before and after peeloff.

Measuring methods of the distribution density of nickel alloy particles in the nickel alloy electroplating layer and the average thickness of the nickel alloy oxide film:

The distribution density of nickel alloy particles was measured by extracting nickel alloy precipitated on the steel sheet surface by the application of the extraction replica method, and then observing by means of a transmission type electron microscope. Measurement of the average thickness of the nickel alloy oxide film was conducted by the application of the Auger electron spectroscopic method.

TABLE 3(1)

| Process | Bath composition | | Temperature | Electric current density |
|---|---|---|---|---|
| Pickling | HCl | 50 g/l | 50 ± 5° C. | — |
| Ni—P plating | $NiSO_4.6H_2O$ | 240 g/l | 40 ± 5° C. | −1.0–3.0 A/dm$^2$ |
| | $NiCl_2.6H_2O$ | 45 g/l | | |
| | $H_3BO_3$ | 30 g/l | | |
| | $H_3PO_3$ | 45 g/l | | |
| | pH | 2.0–3.0 | | |
| Ni—B plating | $NiSO_4.6H_2O$ | 240 g/l | 55 ± 5° C. | −5.0–3.0 A/dm$^2$ |
| | $NiCl_2.6H_2O$ | 45 g/l | | |
| | $H_3BO_3$ | 30 g/l | | |
| | $(CH_3)_3NBH_3$ | 5 g/l | | |
| | pH | 3.0–4.0 | | |
| Ni—S plating | $NiSO_4.6H_2O$ | 50 g/l | 30 ± 5° C. | −1.0–3.0 A/dm$^2$ |
| | $(NH_4)_2SO_4$ | 30 g/l | | |
| | $Na_2C_6H_5O_7.2H_2O$ | 15 g/l | | |
| | $Na_2S_2O_3.5H_2O$ | 50 g/l | | |
| | pH | 3.5–4.5 | | |
| Ni—P—B plating | $NiSO_4.6H_2O$ | 240 g/l | 50 ± 5° C. | −1.0–3.0 A/dm$^2$ |
| | $NiCl_2.6H_2O$ | 45 g/l | | |
| | $H_3BO_3$ | 30 g/l | | |
| | $H_3PO_3$ | 15 g/l | | |
| | $(CH_3)_3NBH_3$ | 5 g/l | | |
| | pH | 2.5–3.5 | | |
| Ni alloy oxide film forming | $NaHCO_3$ | 20 g/l | 25 ± 5° C. | 0.1–1.0 A/dm$^2$ |

TABLE 3(2)

| Process | Bath composition | | Temperature | Electric current density |
|---|---|---|---|---|
| Pickling | HCl | 50 g/l | 50 ± 5° C. | — |
| Ni—P—S plating | $NiSO_4.6H_2O$ | 240 g/l | 40 ± 5° C. | −1.0–3.0 A/dm$^2$ |
| | $NiCl_2.6H_2O$ | 45 g/l | | |
| | $H_3BO_3$ | 30 g/l | | |
| | $H_3PO_3$ | 45 g/l | | |
| | $Na_2S_2O_3.5H_2O$ | 65 g/l | | |
| | pH | 2.5–3.5 | | |
| Ni—B—S plating | $NiSO_4.6H_2O$ | 240 g/l | 40 ± 5° C. | 1.0–3.0 A/dm$^2$ |
| | $NiCl_2.6H_2O$ | 45 g/l | | |
| | $H_3BO_3$ | 30 g/l | | |
| | $(CH_3)_3NBH_3$ | 5 g/l | | |
| | $Na_2S_2O_3.5H_2O$ | 65 g/l | | |
| | pH | 2.5–3.5 | | |
| Ni—P—B—S plating | $NiSO_4.6H_2O$ | 240 g/l | 40 ± 5° C. | 1.0–3.0 A/dm$^2$ |
| | $NiCl_2.6H_2O$ | 45 g/l | | |
| | $H_3BO_3$ | 30 g/l | | |
| | $H_3PO_3$ | 15 g/l | | |
| | $(CH_3)_3NBH_3$ | 5 g/l | | |
| | $Na_2S_2O_3.5H_2O$ | 65 g/l | | |
| | pH | 2.5–3.5 | | |
| Ni alloy oxide film forming | $NaHCO_3$ | 20 g/l | 25 ± 5° C. | 0.1–1.0 A/dm$^2$ |

TABLE 4

| | Continuous-annealed cold-rolled steel sheet | | | | Nickel alloy plating layer | | | | Press-formability | | Phosphating-treatability | | | |
|---|---|---|---|---|---|---|---|---|---|---|---|---|---|---|
| No. | Steel grade | Reduction ratio (%) | Heating temperature (°C.) | Lankford value | Chemical composition | Plating weight (mg/m$^2$) | Distribution density of Ni alloy particles (per m$^2$) | Oxide film of Ni alloy (Å) | Frictional coefficient (μ) | Limiting drawing ratio | Deposited amount (mg/m$^2$) | Number of initially precipitated nuclei (per m$^2$) | Crystal grain size (μm) | Appearance |
| Sample of the invention | | | | | | | | | | | | | | |
| 1 | B | 75 | 750 | 1.55 | Ni—P | 20(5) | $2 \times 10^{13}$ | 13 | 0.12 | 2.05 | 2.1 | $3 \times 10^{11}$ | 1.7 | ◎ |
| 2 | G | 80 | 830 | 1.10 | Ni—P | 45(5) | $5 \times 10^{13}$ | 15 | 0.11 | 1.97 | 2.2 | $4 \times 10^{11}$ | 2.3 | ◎ |

TABLE 4-continued

| | Continuous-annealed cold-rolled steel sheet | | | | Nickel alloy plating layer | | | | Press-formability | | Phosphating-treatability | | | |
|---|---|---|---|---|---|---|---|---|---|---|---|---|---|---|
| No. | Steel grade | Reduction ratio (%) | Heating temperature (°C.) | Lankford value | Chemical composition | Plating weight (mg/m²) | Distribution density of Ni alloy particles (per m²) | Oxide film of Ni alloy (Å) | Frictional coefficient (μ) | Limiting drawing ratio | Deposited amount (mg/m²) | Number of initially precipitated nuclei (per m²) | Crystal grain size (μm) | Appearance |
| 3 | C | 75 | 830 | 1.80 | Ni—P | 7(8) | $3 \times 10^{12}$ | 10 | 0.12 | 2.09 | 2.1 | $3 \times 10^{10}$ | 2.6 | ⊚ |
| 4 | C | 80 | 830 | 1.85 | Ni—P | 35(6) | $2 \times 10^{14}$ | 7 | 0.13 | 2.09 | 2.0 | $2 \times 10^{11}$ | 2.0 | ⊚ |
| 5 | C | 85 | 830 | 1.85 | Ni—P | 60(5) | $1 \times 10^{14}$ | 8 | 0.12 | 2.11 | 2.2 | $2 \times 10^{11}$ | 1.5 | ⊚ |
| 6 | D | 75 | 830 | 2.00 | Ni—P—S (P:6;S:6) | 17(12) | $4 \times 10^{13}$ | 5 | 0.12 | 2.11 | 2.5 | $1 \times 10^{11}$ | 2.1 | ⊚ |
| 7 | D | 80 | 830 | 2.10 | Ni—P | 42(3) | $3 \times 10^{13}$ | 16 | 0.12 | 2.14 | 2.5 | $3 \times 10^{11}$ | 1.5 | ⊚ |
| 8 | D | 85 | 830 | 2.15 | Ni—P | 5(2) | $1 \times 10^{12}$ | 13 | 0.13 | 2.15 | 2.7 | $1 \times 10^{10}$ | 3.0 | ⊚ |
| 9 | E | 75 | 830 | 2.15 | Ni—B—S (B:5;S:5) | 22(10) | $3 \times 10^{12}$ | 20 | 0.11 | 2.13 | 2.5 | $8 \times 10^{10}$ | 2.2 | ⊚ |
| 10 | E | 80 | 830 | 2.25 | Ni—P | 12(4) | $2 \times 10^{12}$ | 11 | 0.12 | 2.14 | 2.6 | $2 \times 10^{10}$ | 2.0 | ⊚ |
| 11 | E | 85 | 830 | 2.25 | Ni—P | 57(3) | $5 \times 10^{14}$ | 4 | 0.12 | 2.14 | 2.1 | $7 \times 10^{11}$ | 2.3 | ⊚ |
| 12 | D | 75 | 830 | 2.00 | Ni—B | 19(2) | $1 \times 10^{13}$ | 7 | 0.14 | 2.12 | 2.1 | $8 \times 10^{10}$ | 2.1 | ⊚ |
| 13 | D | 80 | 830 | 2.10 | Ni—B | 53(3) | $9 \times 10^{13}$ | 6 | 0.11 | 2.13 | 2.3 | $3 \times 10^{11}$ | 1.5 | ⊚ |
| 14 | E | 75 | 830 | 2.15 | Ni—B | 38(5) | $8 \times 10^{13}$ | 14 | 0.11 | 2.14 | 2.2 | $2 \times 10^{11}$ | 1.5 | ⊚ |
| 15 | D | 75 | 830 | 2.00 | Ni—S | 14(8) | $2 \times 10^{12}$ | 21 | 0.12 | 2.10 | 2.1 | $9 \times 10^{10}$ | 1.7 | ⊚ |
| 16 | D | 80 | 830 | 2.10 | Ni—S | 28(12) | $1 \times 10^{13}$ | 8 | 0.12 | 2.12 | 2.4 | $2 \times 10^{11}$ | 1.8 | ⊚ |
| 17 | E | 80 | 830 | 2.25 | Ni—S | 43(14) | $7 \times 10^{13}$ | 17 | 0.12 | 2.15 | 2.4 | $3 \times 10^{11}$ | 2.0 | ⊚ |

Figures in ( ) in the column of the plating weight of the nickel alloy plating layer represent P, B and S contents (wt. %)

TABLE 5

| | Continuous-annealed cold-rolled steel sheet | | | | Nickel alloy plating layer | | | | Press-formability | | Phosphating-treatability | | | |
|---|---|---|---|---|---|---|---|---|---|---|---|---|---|---|
| No. | Steel grade | Reduction ratio (%) | Heating temperature (°C.) | Lankford value | Chemical composition and hardness | Plating weight (mg/m²) | Distribution density of Ni alloy particles (per m²) | Oxide film of Ni alloy (Å) | Frictional coefficient (μ) | Limiting drawing ratio | Deposited amount (mg/m²) | Number of initially precipitated nuclei (per m²) | Crystal grain size (μm) | Appearance |
| Sample for comparison | | | | | | | | | | | | | | |
| 1 | D | 80 | 830 | 2.10 | Ni—P | 2(5) | $8 \times 10^{10}$ | 3 | 0.16 | 2.11 | 3.5 | $1 \times 10^{9}$ | 5.0 | Δ |
| 2 | D | 80 | 830 | 2.10 | Ni—P | 23(5) | $4 \times 10^{13}$ | 78 | 0.12 | 2.12 | 2.3 | $6 \times 10^{8}$ | 5.5 | X |
| 3 | E | 80 | 830 | 2.25 | Ni—P | 25(7) | $5 \times 10^{13}$ | 260 | 0.12 | 2.14 | 1.8 | $3 \times 10^{8}$ | 7.0 | X |
| 4 | D | 80 | 830 | 2.10 | Ni—B | 32(5) | $3 \times 10^{13}$ | 51 | 0.11 | 2.12 | 3.5 | $9 \times 10^{9}$ | 3.0 | Δ |
| 5 | E | 80 | 830 | 2.25 | Ni—B | 41(7) | $2 \times 10^{14}$ | 53 | 0.12 | 2.14 | 3.8 | $1 \times 10^{10}$ | 4.2 | Δ |
| 6 | D | 80 | 830 | 2.10 | Ni—P | 150(11) | $9 \times 10^{11}$ | 18 | 0.11 | 2.12 | 3.2 | $8 \times 10^{9}$ | 4.5 | Δ |
| 7 | E | 80 | 830 | 2.25 | Ni—P | 230(9) | $2 \times 10^{11}$ | 18 | 0.12 | 2.13 | 3.6 | $5 \times 10^{9}$ | 5.0 | Δ |
| 8 | D | 80 | 830 | 2.10 | Ni—P Hv343 | 520(1) | — | 13 | — | — | — | — | — | — |
| 9 | D | 80 | 830 | 2.10 | Ni—P Hv451 | 510(5) | — | 16 | — | — | — | — | — | — |
| 10 | D | 80 | 830 | 2.10 | Ni—P Hv465 | 520(8) | — | 15 | — | — | — | — | — | — |
| 11 | D | 80 | 830 | 2.10 | Ni—P Hv602 | 490(15) | — | 13 | — | — | — | — | — | — |
| 12 | D | 80 | 830 | 2.10 | Ni—B Hv785 | 510(8) | — | 14 | — | — | — | — | — | — |
| 13 | D | 80 | 830 | 2.10 | Ni—S Hv265 | 400(9) | — | 15 | — | — | — | — | — | — |

Figures in ( ) in the column of the plating weight of the nickel alloy plating layer represent P, B and S contents (wt. %)

As shown in Tables 4 and 5, the samples of the invention Nos. 1 to 17, of which the plating weight of the nickel alloy electroplating layer, the distribution density of nickel alloy particles and the average thickness of the nickel alloy oxide film were within the scope of the present invention, showed satisfactory results of tests and were excellent in press-formability and phosphating-treatability.

In contrast, the sample for comparison No. 1 having a low plating weight of the nickel-phosphorus alloy electroplating layer outside the scope of the present invention and a low distribution density of the nickel-phosphorus alloy particles outside the scope of the present invention, showed a high frictional coefficient and a large grain size of phosphate crystals resulting in inferior press-formability and phosphating-treatability.

The samples for comparison Nos. 2 and 3, of which the average thickness of the nickel-phosphorus alloy oxide film was large outside the scope of the present invention, showed a large grain size of phosphate crystals, an insufficient deposited amount of the phosphate film and an inferior phosphating-treatability.

The samples for comparison Nos. 4 and 5, of which the average thickness of the nickel-boron alloy oxide film was large outside the scope of the present invention, showed a large grain size of phosphate crystals and an inferior phosphating-treatability.

The samples for comparison Nos. 6 and 7, of which the plating weight of the nickel-phosphorus alloy electroplating layer was large outside the scope of the present invention, showed a large grain size of phosphate crystals, and an inferior press-formability and phosphating-treatability.

The samples for comparison Nos. 8 and 13, revealed that the nickel-phosphorus alloy electroplating layer and the nickel-boron alloy electroplating layer had a higher hardness than the nickel-sulfur alloy electroplating layer.

Figure 2:
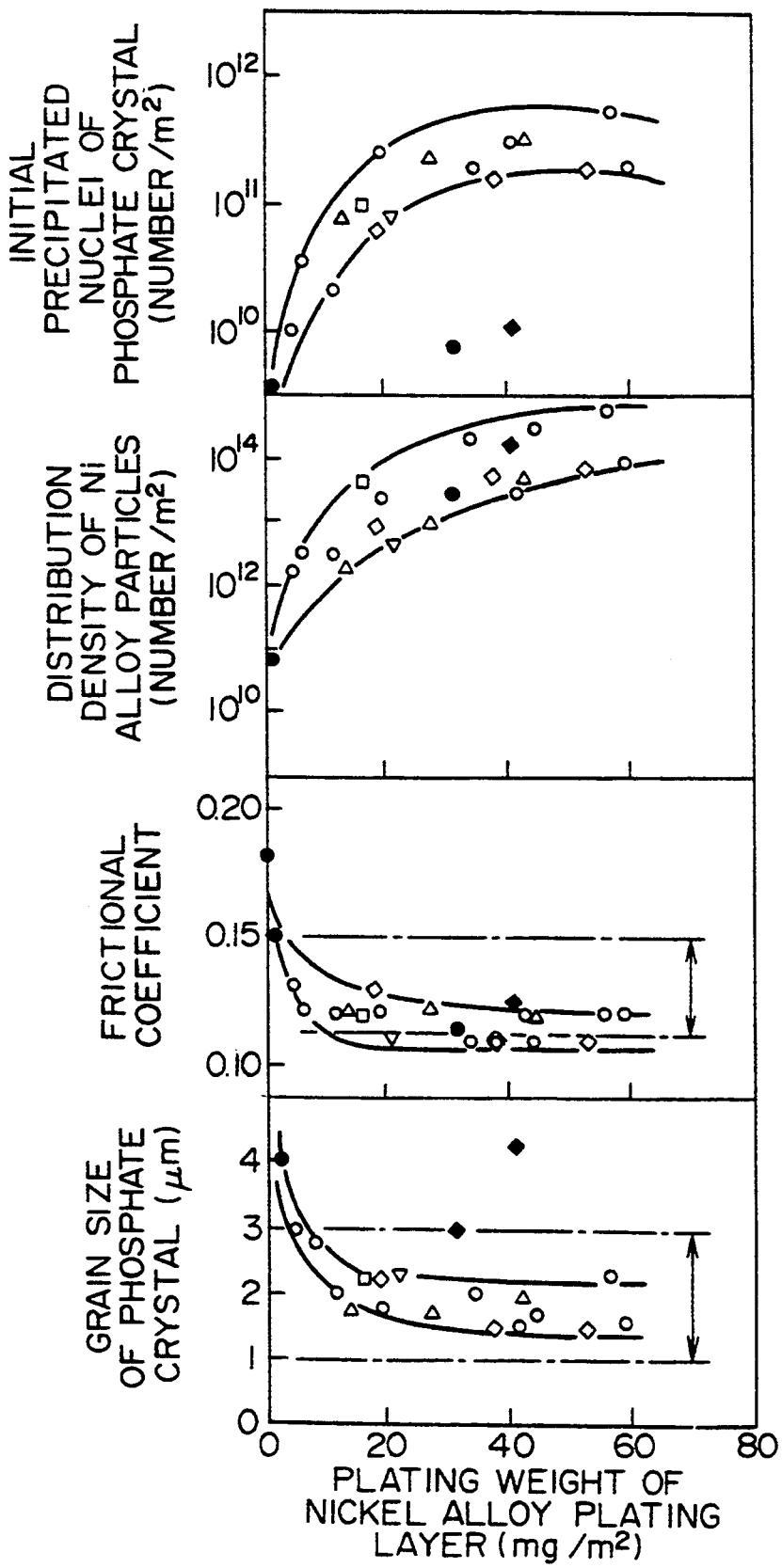
FIG. 2 is a graph illustrating the effect of the plating weight of the nickel alloy electroplating layer on the number of initially precipitated nuclei of phosphate, the distribution density of nickel alloy particles, the frictional coefficient and the grain size of crystals of the phosphate film, for the examples of the present invention and the examples for comparison outside the scope of the present invention.

FIG. 2 is a graph illustrating the effect of the plating weight of the nickel alloy electroplating layer on the number of initially precipitated nuclei of phosphate, the distribution density of nickel alloy particles, the frictional coefficient and the grain size of crystals of the phosphate film, for the examples of the present invention and the examples for comparison outside the scope of the present invention. In FIG. 2, the mark "o" represents the sample of the invention, having a nickel-phosphorus alloy electroplating layer the mark " " represents the sample of the invention having a nickel-boron alloy electroplating layer, the mark "Δ" represents the sample of the invention having a nickel-sulfur alloy electroplating layer, the mark "□" represents the sample of the invention having a nickel-phosphorus-sulfur alloy electroplating layer, the mark "▽" represents the sample of the invention having a nickel-boron-sulfur alloy electroplating layer, the mark " " represents the sample for comparison having a nickel-phosphorus alloy electroplating layer, and the mark " " represents the sample for comparison having a nickel-boron alloy electroplating layer. In FIG. 2, the range of the grain size of crystals of the phosphate film formed on the surface of the nickel alloy electroplated cold-rolled steel sheet prepared from the steel F and the range of the frictional coefficient are indicated by the arrows. FIG. 2 suggests that, with a plating weight of the nickel alloy electroplating layer within the scope of the present invention, satisfactory results are available in the number of initially precipitated nuclei of phosphate, the distribution density of nickel alloy particles, the frictional coefficient and the grain size of phosphate crystals as in the box-annealed cold-rolled steel sheet.

Figure 3:
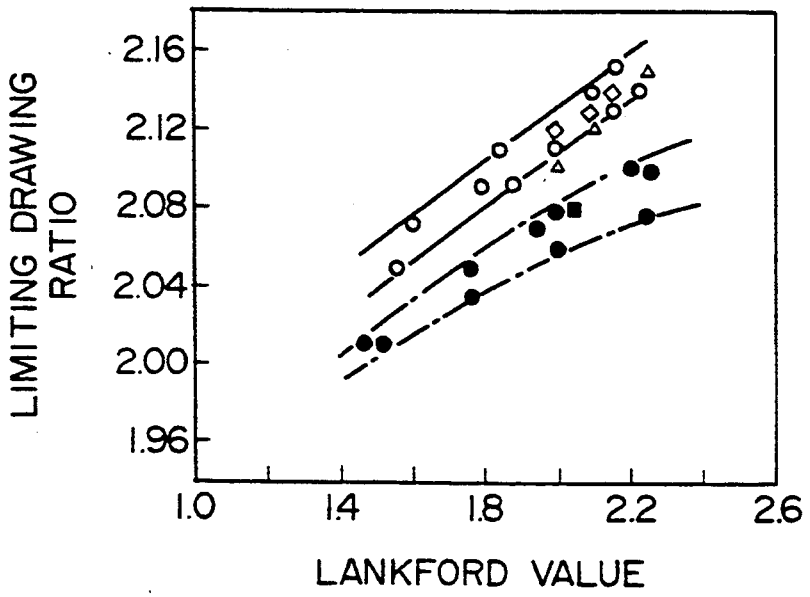
FIG. 3 is a graph illustrating the relationship between the Lankford value and the limiting drawing ratio, for the examples of the present invention and the examples for comparison outside the scope of the present invention.

FIG. 3 is a graph illustrating the relationship between the Lankford value and the limiting drawing ratio, for the examples of the present invention and the examples for comparison outside the scope of the present invention. In FIG. 3, the mark "o" represents the sample of the invention, having a nickel-phosphorus alloy electroplating layer, the mark " " represents the sample of the invention having a nickel-boron alloy electroplating layer, the mark "Δ" represents the sample of the invention having a nickel-sulfur alloy electroplating layer, and the mark " " represents the sample for comparison having a nickel-phosphorus alloy electroplating layer. FIG. 3 suggests that there occur differences in the Lankford value and the limiting drawing ratio between the examples of the present invention and the examples for comparison.

Figure 4:
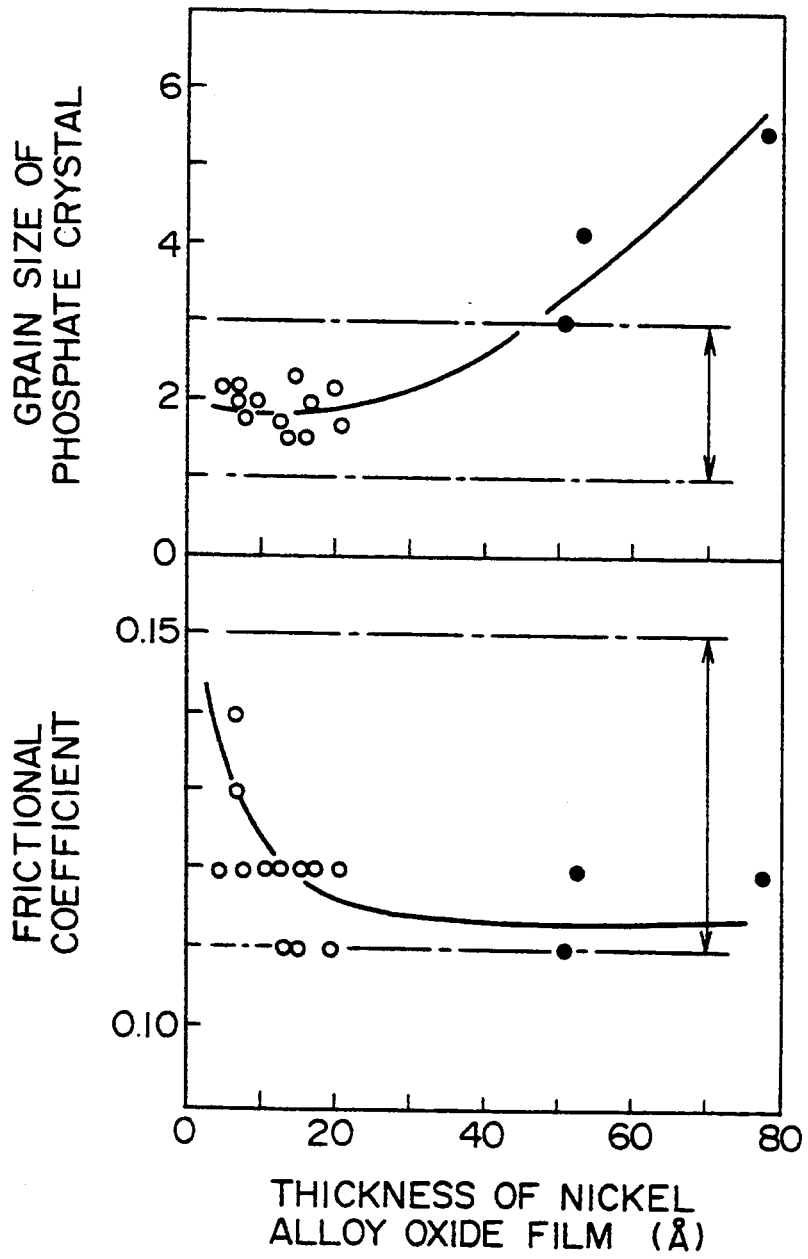
FIG. 4 is a graph illustrating the effect of the average thickness of the nickel alloy oxide film on the grain size of crystals of the phosphate film and the frictional coefficient, for the examples of the present invention and the examples for comparison outside the scope of the present invention.
Figure 5:
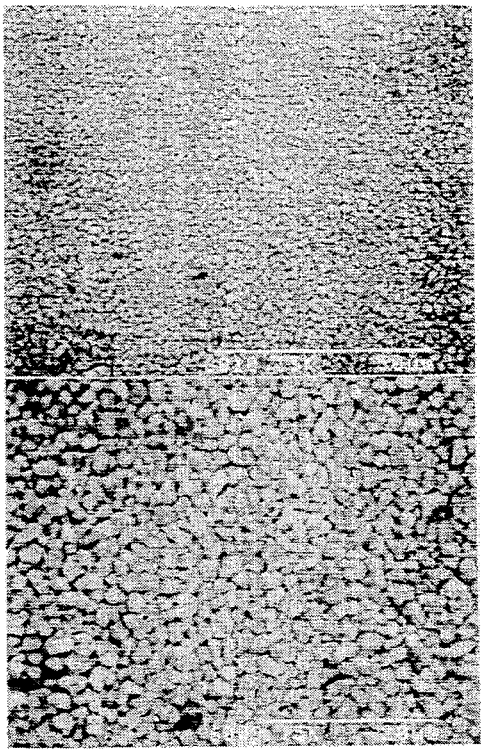
FIG. 5 is an SEM micrograph showing the metallurgical structure of crystals of the phosphate film formed on the surface of the box-annealed cold-rolled steel sheet.
Figure 6:
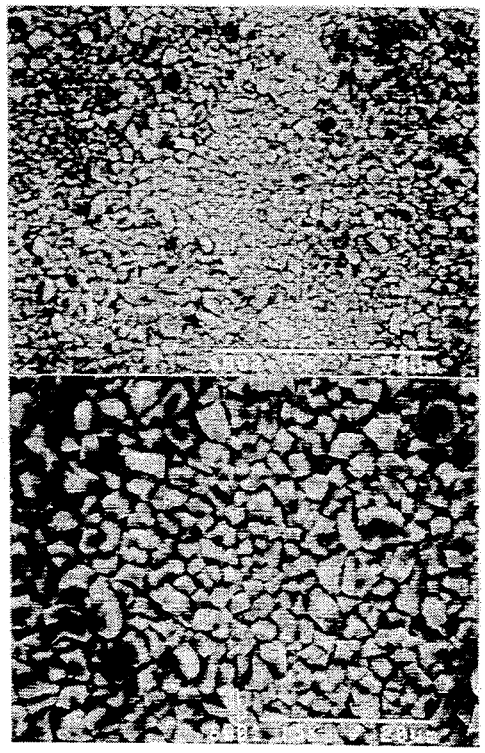
FIG. 6 is an SEM micrograph showing the metallurgical structure of crystals of the phosphate film formed on the surface of the continuous-annealed cold-rolled steel sheet.
Figure 7:
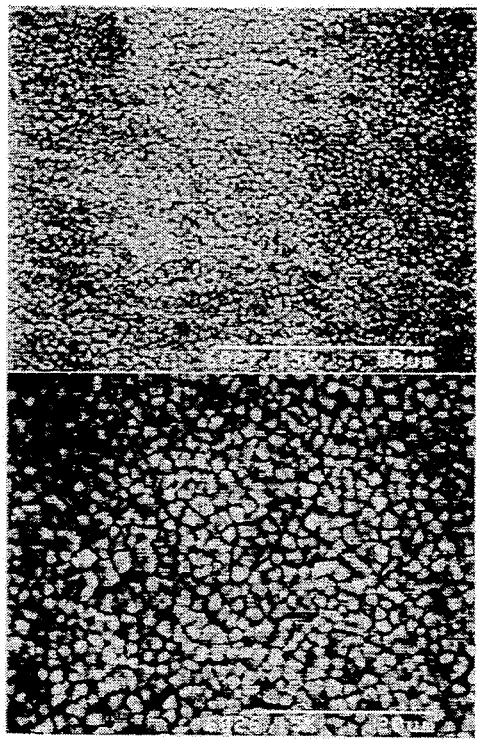
FIG. 7 is an SEM micrograph showing the metallurgical structure of crystals of the phosphate film formed on the surface of the sample of the invention No. 1, which has a nickel alloy electroplating layer having a plating weight of 20 mg/m$^2$ and a nickel alloy oxide film having an average thickness of 13 Å.
Figure 8:
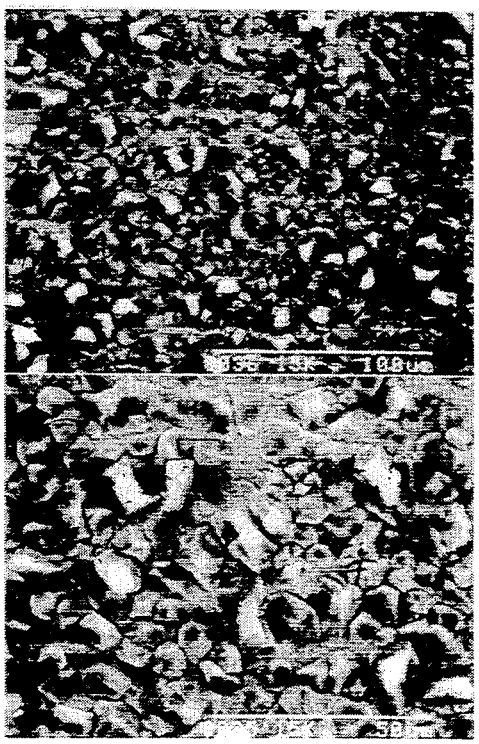
FIG. 8 is an SEM micrograph showing the metallurgical structure of crystals of the phosphate film formed on the surface of the sample for comparison No. 6 outside the scope of the present invention, which has a nickel alloy plating layer having a plating weight of 150 mg/m$^2$ and a nickel alloy oxide film having an average thickness of 18 Å.

FIG. 4 is a graph illustrating the effect of the average thickness of the nickel alloy oxide film on the grain size of crystals of the phosphate film and the frictional coefficient, for the samples of the present invention and the examples for comparison outside the scope of the present invention. In FIG. 4, the mark "o" represents-the sample of the invention, and the mark " " represents the sample for comparison. In FIG. 4, the range of the grain size of crystals of the phosphate film formed on the surface of the nickel alloy electroplated cold-rolled steel sheet prepared from the steel F and the range of the frictional coefficient are indicated by the arrows. FIG. 4 suggests that, even with a plating weight of the nickel alloy electroplating layer within the scope of the present invention, if the average thickness of the nickel alloy oxide film is low outside the scope of the present invention, the frictional coefficient becomes higher. With a high average thickness of the nickel alloy oxide film outside the scope of the present invention, on the other hand, the grain size of phosphate crystals becomes larger, thus resulting in an inferior phosphating-treatability.

According to the present invention, as described above in detail, it is possible to obtain a nickel alloy electroplated cold-rolled steel sheet for deep drawing excellent in press-formability and phosphating-treatability, suitable for the application of the continuous annealing treatment and a method for manufacturing same, thus providing industrially useful effects.

What is claimed is:

1. A nickel alloy electroplated cold-rolled steel sheet excellent in press-formability and phosphating-treatability, which comprises:

a cold-rolled steel sheet consisting essentially of:
carbon (C): up to 0.06 wt. %,
silicon (Si): up to 0.5 wt. %,
manganese (Mn): up to 2.5 wt. %,
phosphorus (P): up to 0.1 wt. %,
sulfur (S): up to 0.025 wt. %
soluble aluminum (Sol. Al): up to 0.10 wt. %,
nitrogen (N): up to 0.005 wt. %, and
the balance being iron (Fe) and incidental impurities;

a nickel alloy electroplating layer, formed on at least one surface of said cold-rolled steel sheet, said nickel alloy electroplating layer consisting of particles of a nickel alloy, precipitated at a distribution density of at least $1\times10^{12}/m^2$, said nickel alloy particles containing at least one of phosphorus (P), boron (B) and sulfur (S) in an amount within a range of from 1 to 15 wt. %, the plating weight of said nickel alloy electroplating layer being within a range of from 5 to 60 $mg/m^2$ per surface of said cold-rolled steel sheet; and a nickel alloy oxide film, formed on the surface of said nickel alloy electroplating layer, having an average thickness within a range of from 0.0002 to under 0.0008 μm.

2. A nickel alloy electroplated cold-rolled steel sheet as claimed in claim 1, wherein:

said cold-rolled steel sheet additionally contains titanium (Ti) in an amount of up to 0.15 wt. %.

3. A nickel alloy electroplated cold-rolled steel sheet as claimed in claim 1, wherein:

said cold-rolled steel sheet additionally contains niobium (Nb) in an amount of up to 0.15 wt. %.

4. A nickel alloy electroplated cold-rolled steel sheet as claimed in claim 2, wherein:

said cold-rolled steel sheet additionally contains niobium (Nb) in an amount of up to 0.15 wt. %.

5. A nickel alloy electroplated cold-rolled steel sheet as claimed in claim 2, wherein:

said cold-rolled steel sheet additionally contains boron (B) in an amount of up to 0.003 wt. %.

6. A nickel alloy electroplated cold-rolled steel sheet as claimed in claim 3, wherein:

said cold-rolled steel sheet additionally contains boron (B) in an amount of up to 0.003 wt. %.

7. A nickel alloy electroplated cold-rolled steel sheet as claimed in claim 4, wherein:

said cold-rolled steel sheet additionally contains boron (B) in an amount of up to 0.003 wt. %.

8. A nickel alloy electroplated cold-rolled steel sheet as claimed in claim 1, wherein the cold-rolled steel sheet consists essentially of:

carbon: from 0.0005 wt. % to 0.06 wt. %
silicon: from 0.005 wt. % to 0.5 wt. %
manganese: from 0.05 wt. % to 2.5 wt. %
phosphorus: from 0.001 wt. % to 0.1 wt. %
sulfur: from 0.005 wt. % to 0.025 wt. %
soluble aluminum: from 0.01 wt. % to 0.10 wt. %
nitrogen: from 0.0005 wt. % to 0.005 wt. %
and the balance being iron and incidental impurities.

9. A nickel alloy electroplated cold-rolled steel sheet as claimed in claim 1, wherein the nickel alloy consists essentially of nickel and phosphorus.

10. A nickel alloy electroplated cold-rolled steel sheet as claimed in claim 1, wherein the nickel alloy consists essentially of nickel and boron.

11. A nickel alloy electroplated cold-rolled steel sheet as claimed in claim 1, wherein the nickel alloy consists essentially of nickel and sulfur.

12. A nickel alloy electroplated cold-rolled steel sheet as claimed in claim 1, wherein the nickel alloy oxide film has an average thickness of 0.0004 μm.

13. A nickel alloy electroplated cold-rolled steel sheet as claimed in claim 1, wherein the nickel alloy oxide film has an average thickness of 0.0005 μm.

14. A nickel alloy electroplated cold-rolled steel sheet as claimed in claim 1, wherein the nickel alloy oxide film has an average thickness of 0.0006 μm.

15. A nickel alloy electroplated cold-rolled steel sheet as claimed in claim 1, wherein the nickel alloy oxide film has an average thickness of 0.0007 μm.

16. A nickel alloy electroplated cold-rolled steel sheet as claimed in claim 1, wherein the nickel alloy oxide film has an average thickness of 0.0008 μm.

* * * * *